US006161351A

United States Patent [19]

Simpson

[11] Patent Number: 6,161,351

[45] Date of Patent: Dec. 19, 2000

[54] BARGE BOARD SYSTEM

[75] Inventor: Kenneth Simpson, Carew Newton, United Kingdom

[73] Assignee: Newmond Building Products Limited, Staffordshire, United Kingdom

[21] Appl. No.: 09/069,482

[22] Filed: Apr. 29, 1998

[30] Foreign Application Priority Data

May 2, 1997 [GB] United Kingdom ..... 9708900

[51] Int. Cl.[7] ..... E04F 13/00

[52] U.S. Cl. ..... 52/311.2; 52/94; 52/95; 52/311.1

[58] Field of Search ..... 52/94, 95, 311.1, 52/287.1, 288.1, 311.2

[56] References Cited

U.S. PATENT DOCUMENTS

| | | | |
|---|---|---|---|
| D. 396,307 | 7/1998 | Toovey | D25/136 |
| 5,555,687 | 9/1996 | Logan et al. | 52/288.01 |
| 5,850,717 | 12/1998 | Schiedegger et al. | 52/288.1 |

FOREIGN PATENT DOCUMENTS

| | | |
|---|---|---|
| 0360465 A1 | 3/1990 | European Pat. Off. . |
| 2126266 | 3/1984 | United Kingdom . |
| 2271588 | 4/1994 | United Kingdom . |
| 2247258 | 11/1994 | United Kingdom . |
| 2306979 | 5/1997 | United Kingdom . |
| WO83/02636 | 8/1983 | WIPO . |

OTHER PUBLICATIONS

Merriam–Webster's Collegiate Dictionary, Tenth Edition, p. 92, Dec. 1997.

*Primary Examiner*—Carl D. Friedman
*Assistant Examiner*—Dennis L. Dorsey
*Attorney, Agent, or Firm*—Dike, Bronstein, Roberts & Cushman, LLP

[57] ABSTRACT

A decorative barge board system 1 comprising at least two discrete decorative members 3,3' of different patterns which are secured to a gable end ladder 2 by fixing means 5,5' which comprise screws 8,8' passing through apertures 7,7' provided in extensions 6,6' of the decorative members 3,3'. The extension 6 of member 3 is of identical outline to the rear face of the adjacent decorative member 3' which is secured over the extension 6 to conceal the fixing means 5. The decorative members 3,3' are jointed one to another by joining means which comprises a male clip attachment located on one end of the decorative member and a female clip attachment located on the opposite end of the decorative member whereby the female clip attachment of one decorative member receives the male clip attachment of an adjacent decorative member.

19 Claims, 11 Drawing Sheets

Figure 1A:
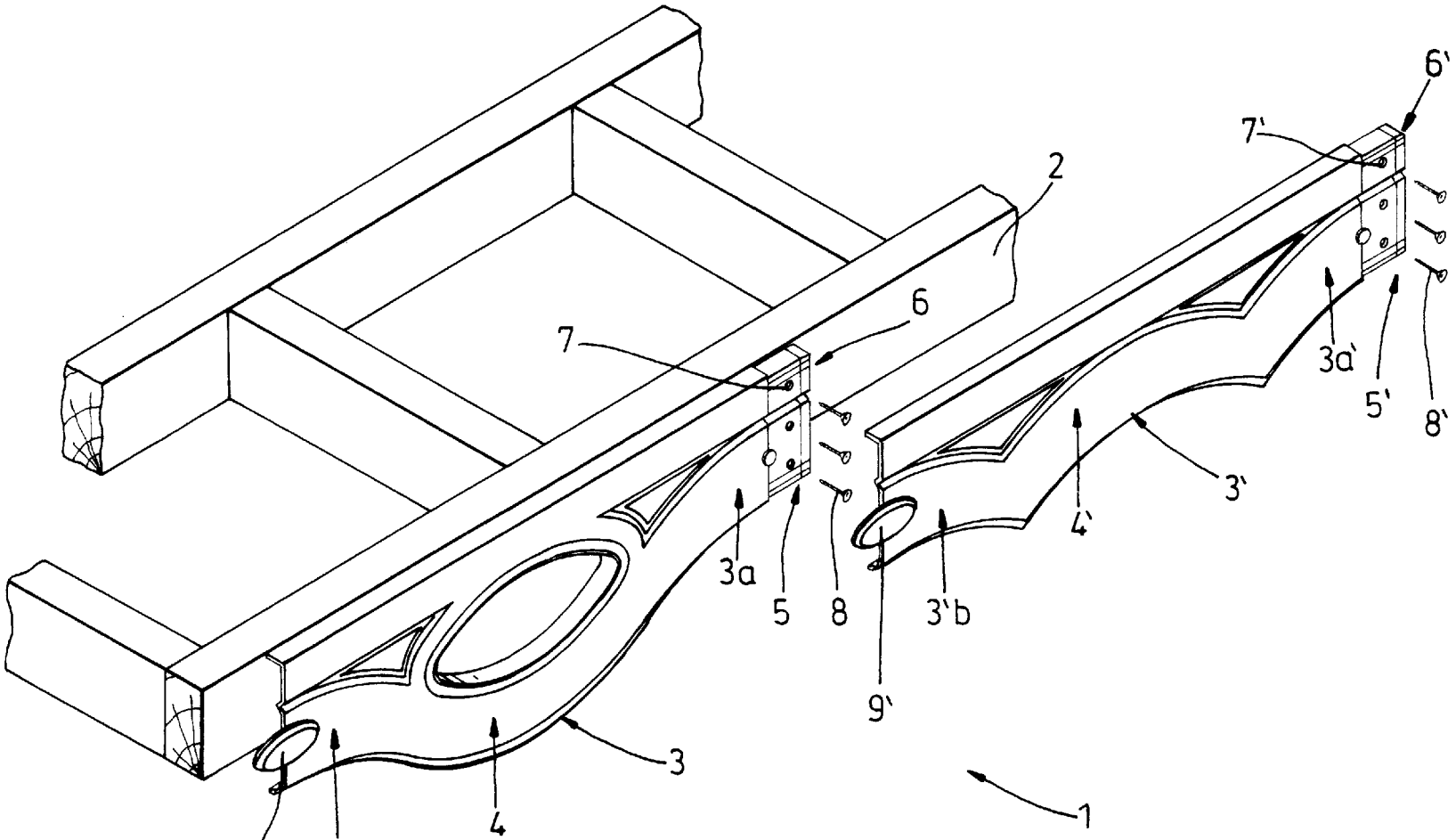

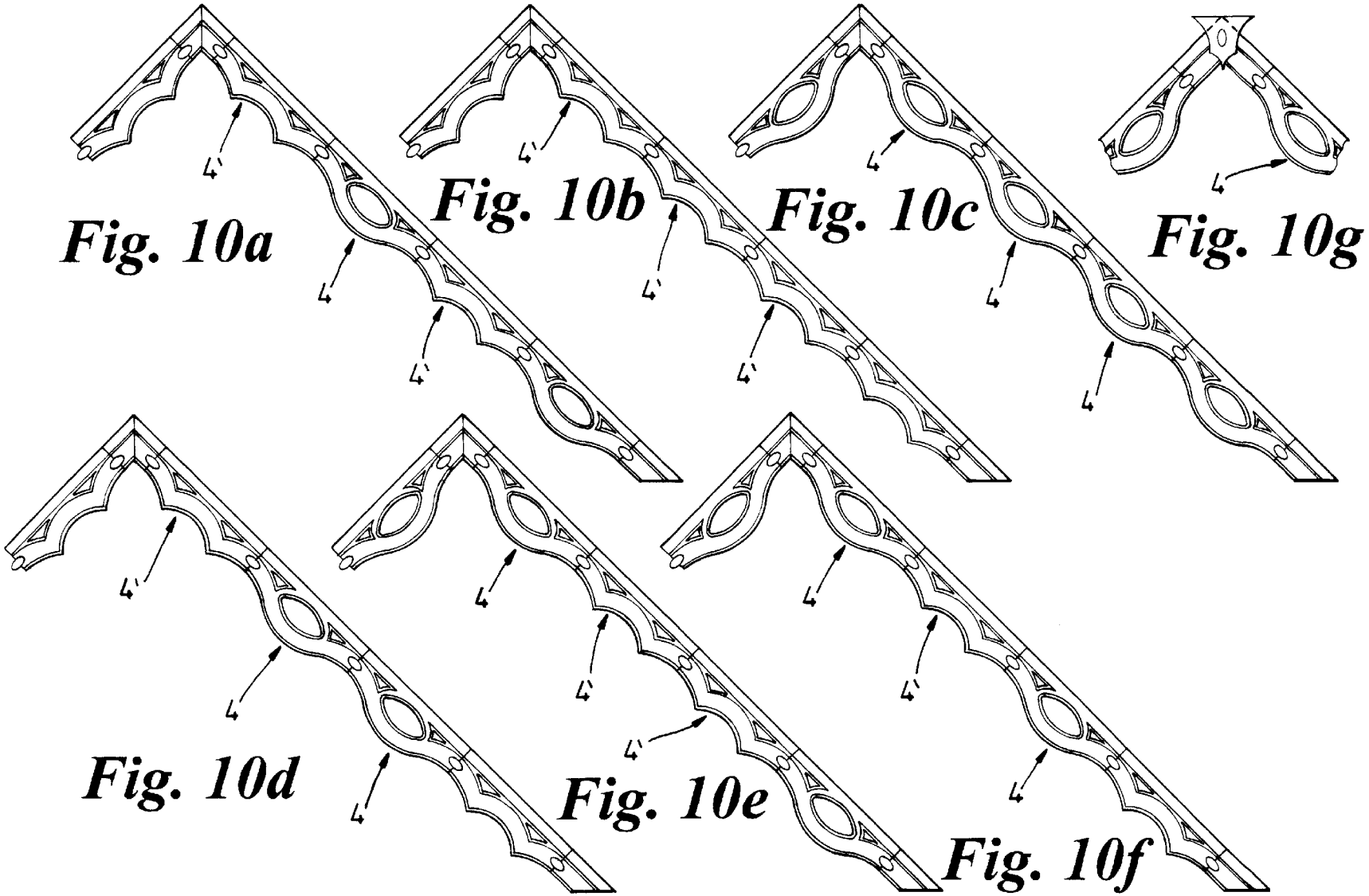
7
7
7

BARGE BOARD SYSTEM

The present invention relates to a barge board system for attachment to new or refurbished buildings to create a decorative finish.

Roofs are usually provided with a barge board at the angled gable end. A barge board extends below the tiles and is secured to the first rafter of the gable end ladder such that it lies parallel to the wall of the building. A fascia board is the equivalent of a barge board but is positioned at the horizontal edge of the roof secured to the rafter ends.

It is known in the art to produce fascias and barge boards made out of timber and having patterns cut out of them to provide a decorative finish, however such decorative barge boards can be difficult to manufacture and secure in place and, also, costly to repair and replace. It is also known to produce fascias and barge boards out of extruded plastics materials such as PVC. The extruded barge boards and fascias can be decorative, however the decorative features are limited to linear patterns and the barge boards and fascias can still be difficult to secure in place owing to the lengths which must be handled. It is also known to cover existing barge boards and fascias with decorative portions or to append decorative portions there from.

The object of the present invention is to provide a decorative barge board system using discrete decorative members which are easily attached to a building and to each other.

Accordingly from a first aspect the present invention provides a barge board system comprising more than one discrete members each having a decorative portion, a fixing means and a joining means by which the discrete members are secured to each other Preferably the discrete members are secured to each other by a positive clipping action.

In the context of the present invention the term barge board is to be construed as including fascia board.

The barge board system of the present invention can be used on site built or prefabricated new buildings or during refurbishment of older buildings or the for the decoration of existing barge boards made of wood, plastics or other materials. The barge board system may also be used for decoration of less permanent dwellings such as static caravans and holiday chalets.

The decorative portions of the discrete members may be identical but preferably there are at least two different patterns of decorative portions. The different patterns of decorative portions may be assembled in different combinations to offer a wide variety of finished decorative barge boards.

The use of discrete members allows the barge board or barge board decoration to be installed in easy to handle sized portions.

Preferably the discrete members are moulded, this allows a wide variety of patterns to be created for the decorative portions and the patterns need not be linear as in the case of extruded one piece barge boards.

Preferably the discrete members are secured to the gable end ladder to form a barge board. Alternatively the discrete members may be secured over a separate barge board or to the rafter ends to form a fascia board.

The fixing means preferably comprises portions of the discrete member provided with holes through which screws can pass. The discrete member may be secured to the face of the rafter ends, gable end ladder or existing barge board and the fixing means may be provided in one or both ends or along the top edge of the member or in extensions of the aforementioned positions. Alternatively the member may be secured to the top face of the rafter end, gable end ladder or existing barge board and the fixing means may be a lip provided along the top edge of the member at an angle thereto, preferably a right angle.

The screws used to secure the discrete members to the rafter end, gable end ladder or barge board are preferably concealed by suitable capping, for example by a portion of an adjacent discrete member or by the roof overhang.

Preferably the joining means comprise male and female attachments provided on adjacent discrete members most preferably to provide a positive clipping action. Thus one end of the discrete member is preferably provided with a female clip attachment and the other end with a male clip attachment whereby the edge portions of adjacent members are in mating contact to provide a planar surface. The advantage of positive clipping is that each joint is properly aligned and the attachment of the discrete members one to another is quick and simple.

Means may be provided to extend the depth of the discrete members from the underside of the tiles in order to enhance visibility of the barge board system from the ground. The depth extension means may be a continuous extruded strip of plastics material or alternatively it may be discrete moulded components. The depth extension means is preferably provided with fixing means and joining means in accordance with the present invention. The discrete member may be secured to the depth extension means by male female attachment. The depth extension means may include further decorative features. Where the means for extending the depth is a continuously extruded strip the further decorative features are linear. When the depth extension means comprises discrete moulded components a wide variety of further decorative features is possible for example repeating some part of the decorative pattern on the decorative portion of the discrete member. The depth extension means may also be used alone to provide a decorative finish.

Preferably one end of each decorative member is provided with a locating member, this locating member may be secured to the rear face of one decorative portion and rest against the rear face of an adjacent decorative portion when the two portions are in mating contact.

Preferably plain mouldings are provided for use at or near the ends of a run to provide easy length adjustment and a simplified finish to the decorative member.

Decorative infills may be provided for use with the decorative member. The infills may be of a contrasting colour to the decorative member or they may provide further decorative features.

The decorative infill preferably push fits into an aperture in the decorative member.

The joints between decorative members fixed along the long run or soffit may be at least partially covered by a further decorative device to break up the straight join line and increase the impression of continuity.

Preferably an end plug is provided to seal the free ends of the decorative members or the plain end spacer when a complete run of decorative members have been put in position. Preferably the plug is solid to allow cutting at the required angle determined by the pitch of the roof. The plug may be secured to the decorative member or plain end spacer by means of a push fit attachment.

Accordingly from a second aspect the present invention provides a method of forming a decorative barge board system comprising the steps of securing at least two discrete members of the first aspect of the present invention to a building or existing barge board by fixing means adjacent to each other such that they are in mating contact and secured one to another by joining means.

The barge board system can be used on site built or prefabricated new buildings or mobile homes or during refurbishment of older buildings or for decoration of existing barge boards which may be of wood, plastics or other materials.

Preferably the discrete members are secured to the gable end ladder or the rafter end or existing barge board of the building. The members are preferably secured by the fixing means which comprise portions of the discrete member provided with holes through which screws can pass.

The discrete members are preferably secured one to another by the joining means which comprise male and female attachments on adjacent members which are secured together by a positive clipping action.

Figure 1B:
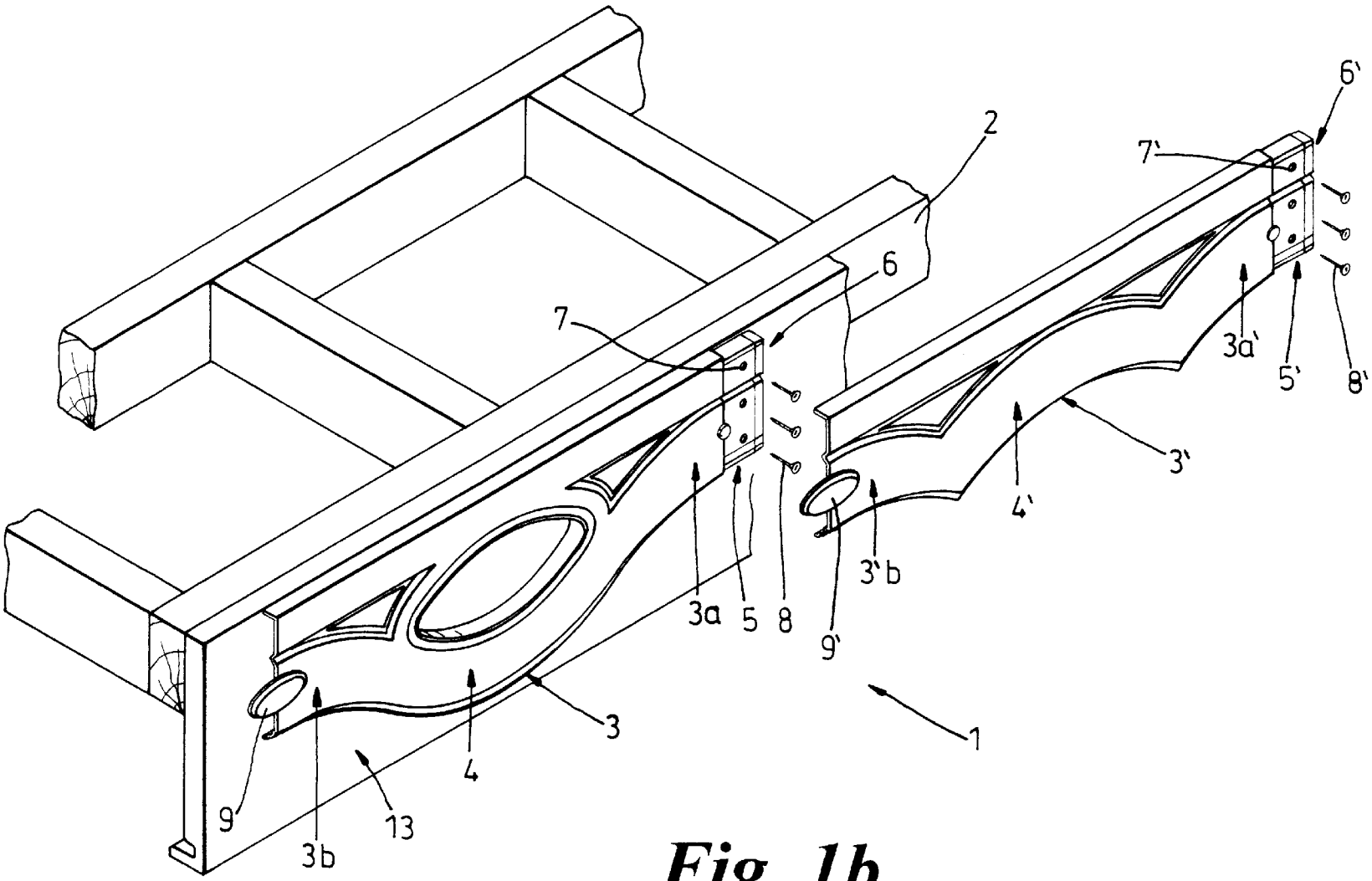
Figure 2A:
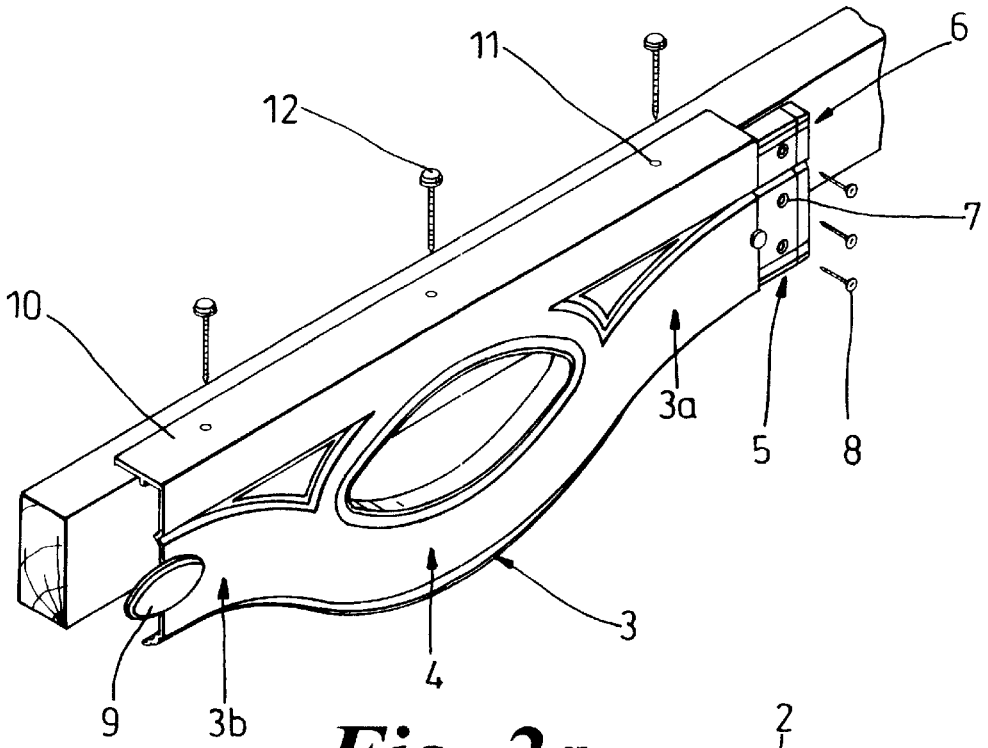
Figure 2B:
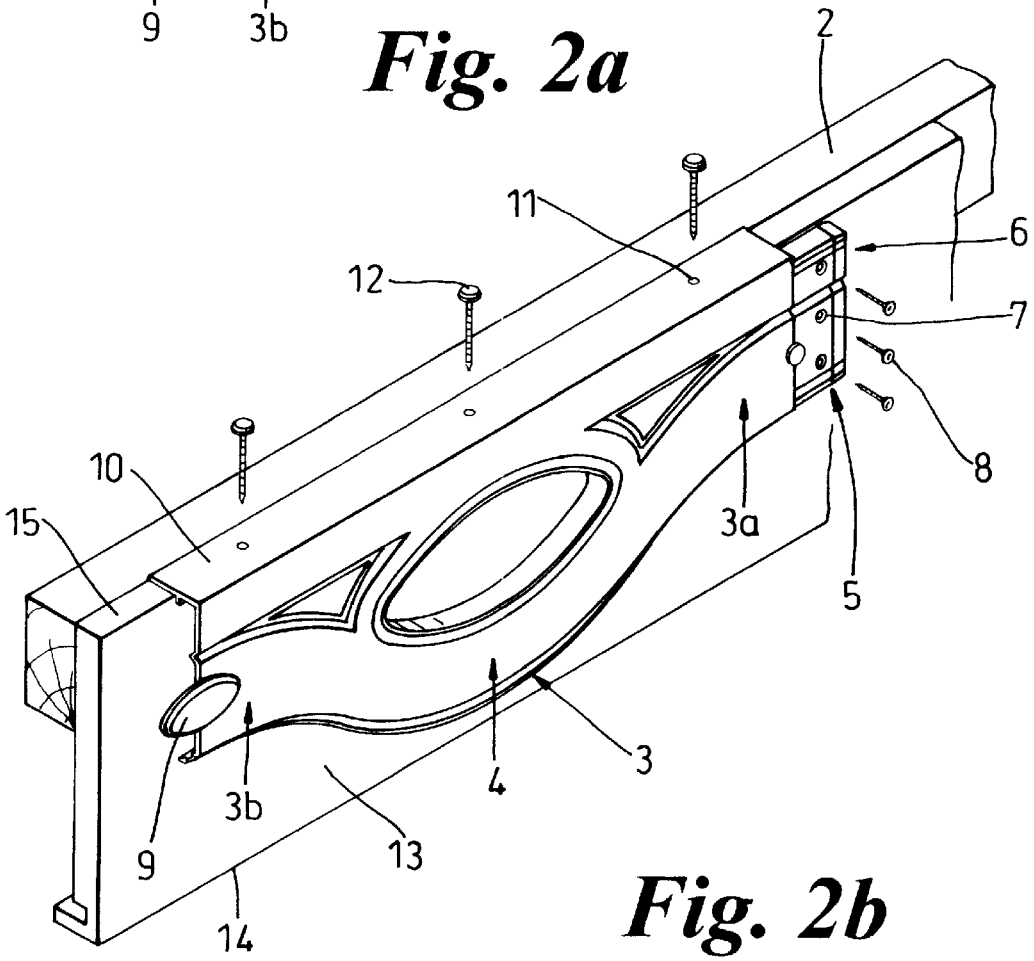
Figure 3A:
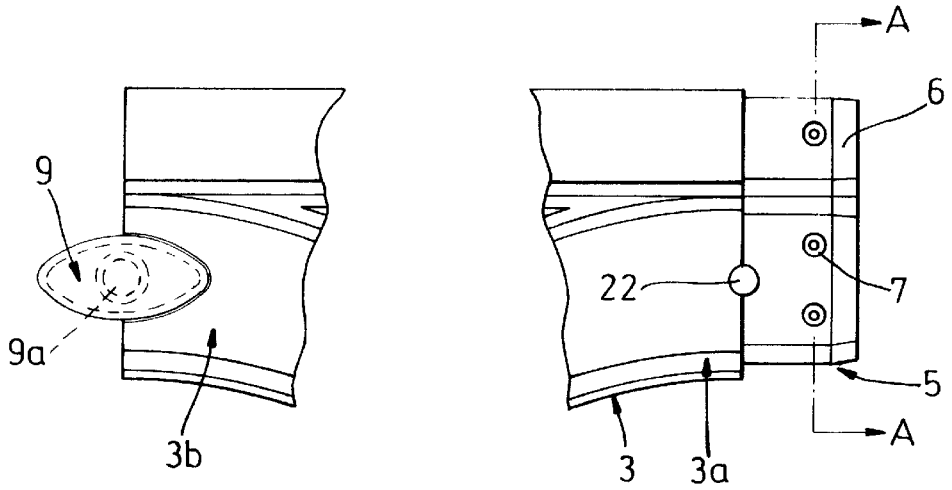

Embodiments of the invention will now be described in detail, by means of example only, with reference to the drawings in which:

FIG. 1*a* is a perspective view of a first embodiment of the barge board system of the present invention secured to the face a gable end ladder;

FIG. 1*b* is a perspective view of the barge board system of FIG. 1*a* fixed to the face of an existing barge board;

FIG. 2*a* is a perspective view of a second embodiment of the barge board system of the present invention secured to the top of the gable end ladder;

FIG. 2*b* is a perspective view of the barge board system of FIG. 2*a* fixed to the top of an existing barge board;

FIG. 3*a* shows a front view of a discrete member having male/female clipping means of the system of FIGS. 1*a*, 1*b* 2*a* or 2*b;*

Figure 3B:
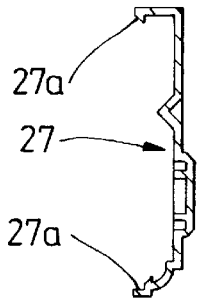
Figure 3C:
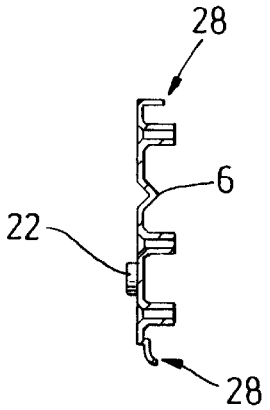
Figure 3D:
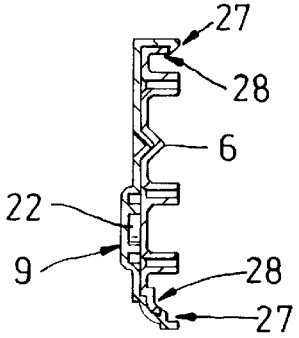

FIG. 3*b* shows a section view of the discrete member of FIG. 3*a* at end 3*b* of discrete member 3 through the centre of the decorative device;

FIG. 3*c* shows a scrap section A—A through apertures 7 at end 3*a* of FIG. 3*a* of discrete member 3;

FIG. 3*d* shows a male/female clip attachment used in FIG. 3*a–c;*

Figure 4B:
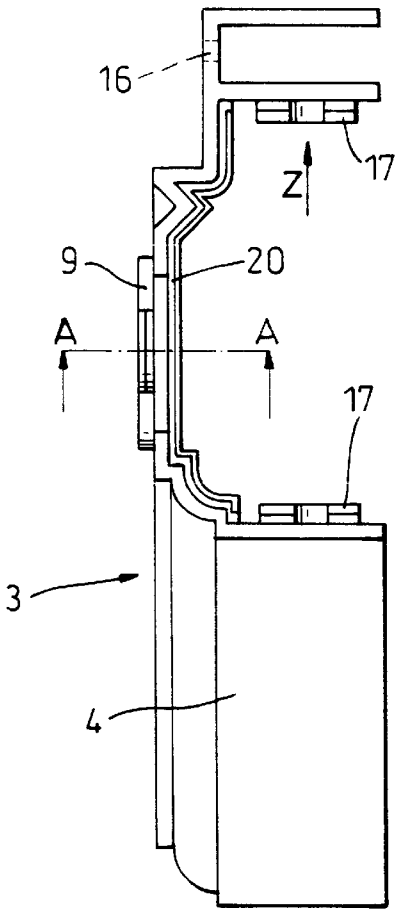
Figure 4A:
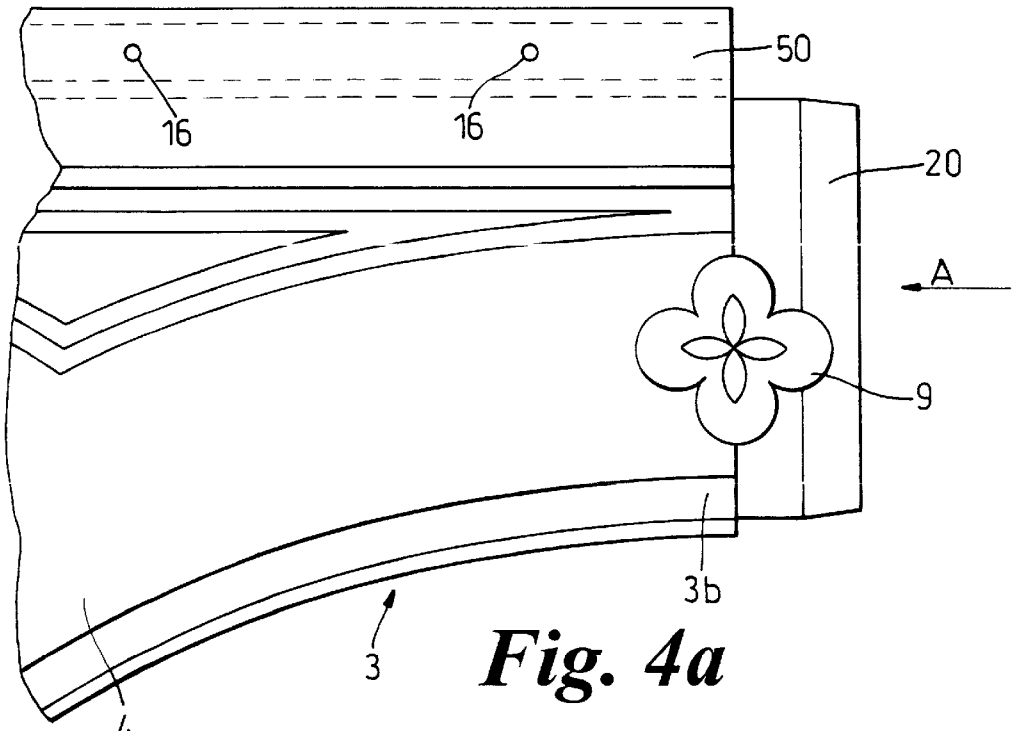

FIG. 4*a* shows a front view of a discrete member having male clipping means and a locating member of the system of FIGS. 1*a*, 1*b*, 2*a* or 2*b;*

Figure 4D:
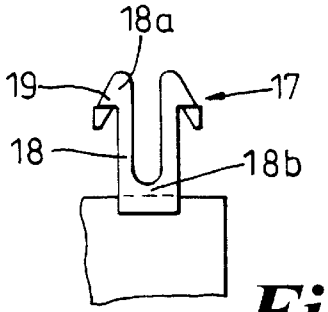
Figure 4C:
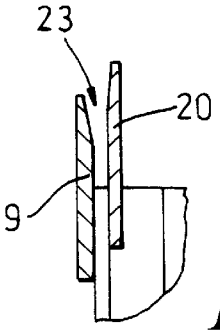

FIG. 4*b* shows an end view of the discrete member of FIG. 4*a* in the direction of arrow A;

FIG. 4*c* shows a section A—A of FIG. 3*b;*

FIG. 4*d* shows a male clip attachment used in FIG. 4*a*, 4*b* and 4*c;*

Figures 5A, 5B, 5C:
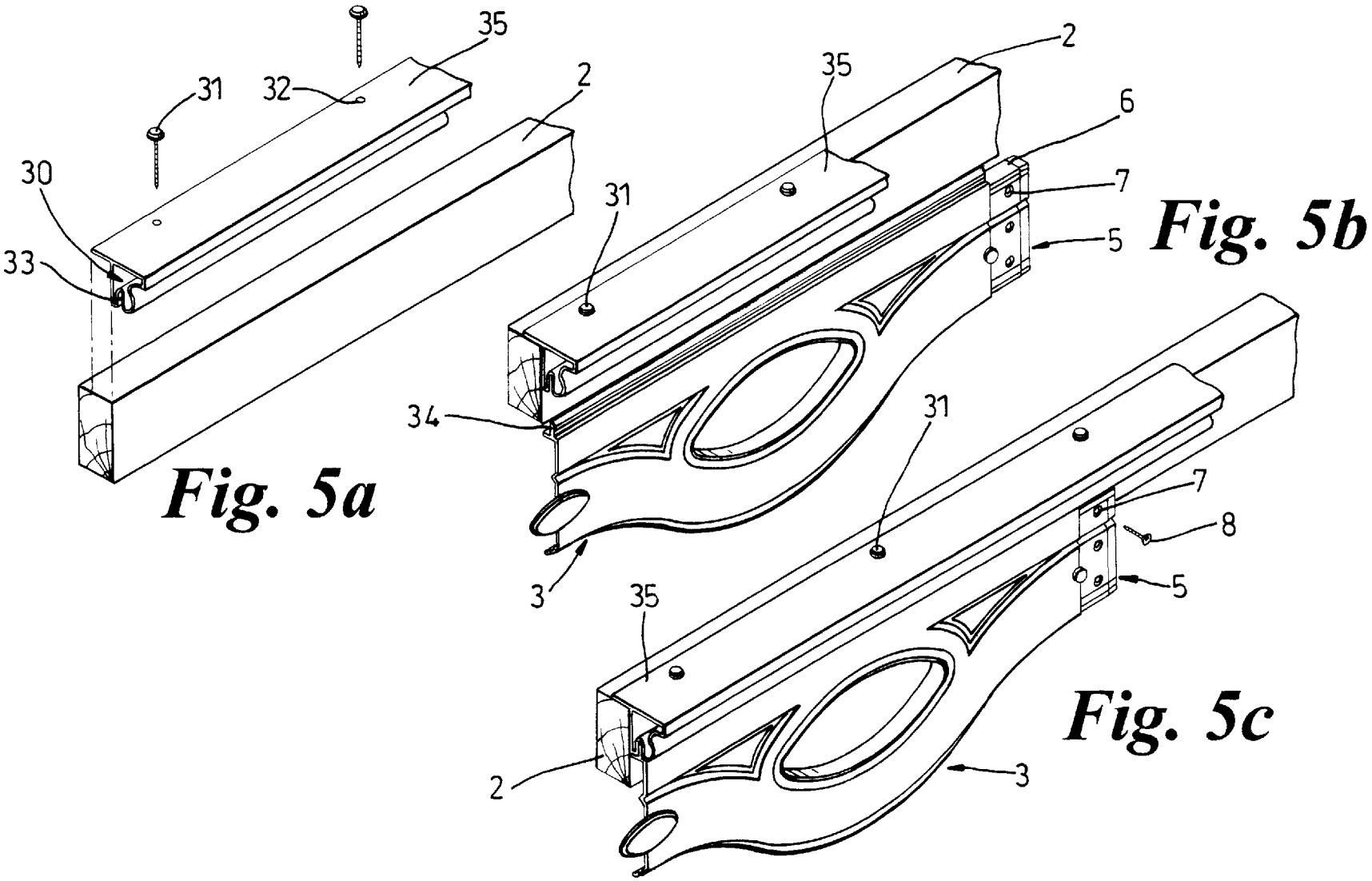
Figures 6A, 6B, 6C:
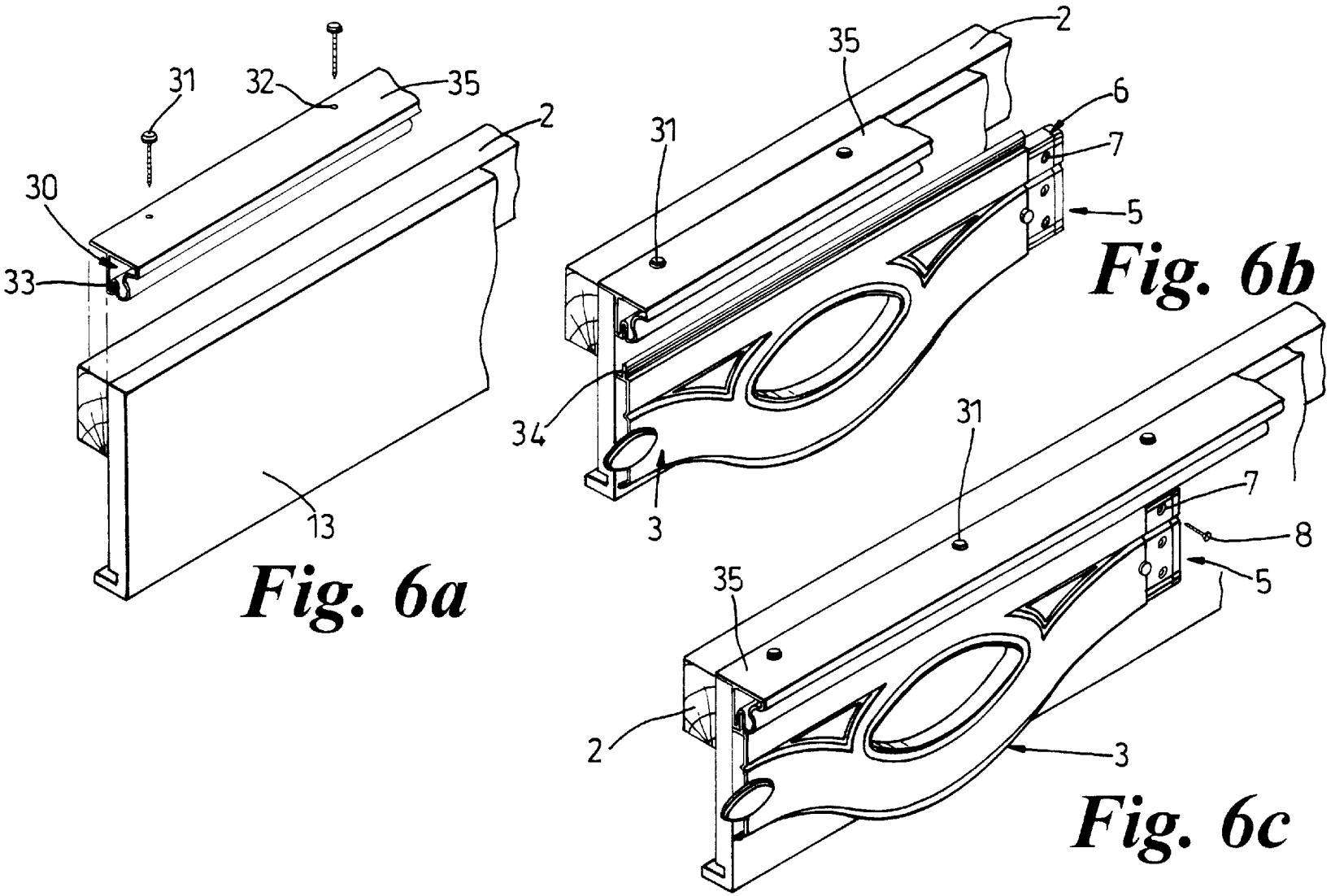
Figures 7A, 7B, 7C:
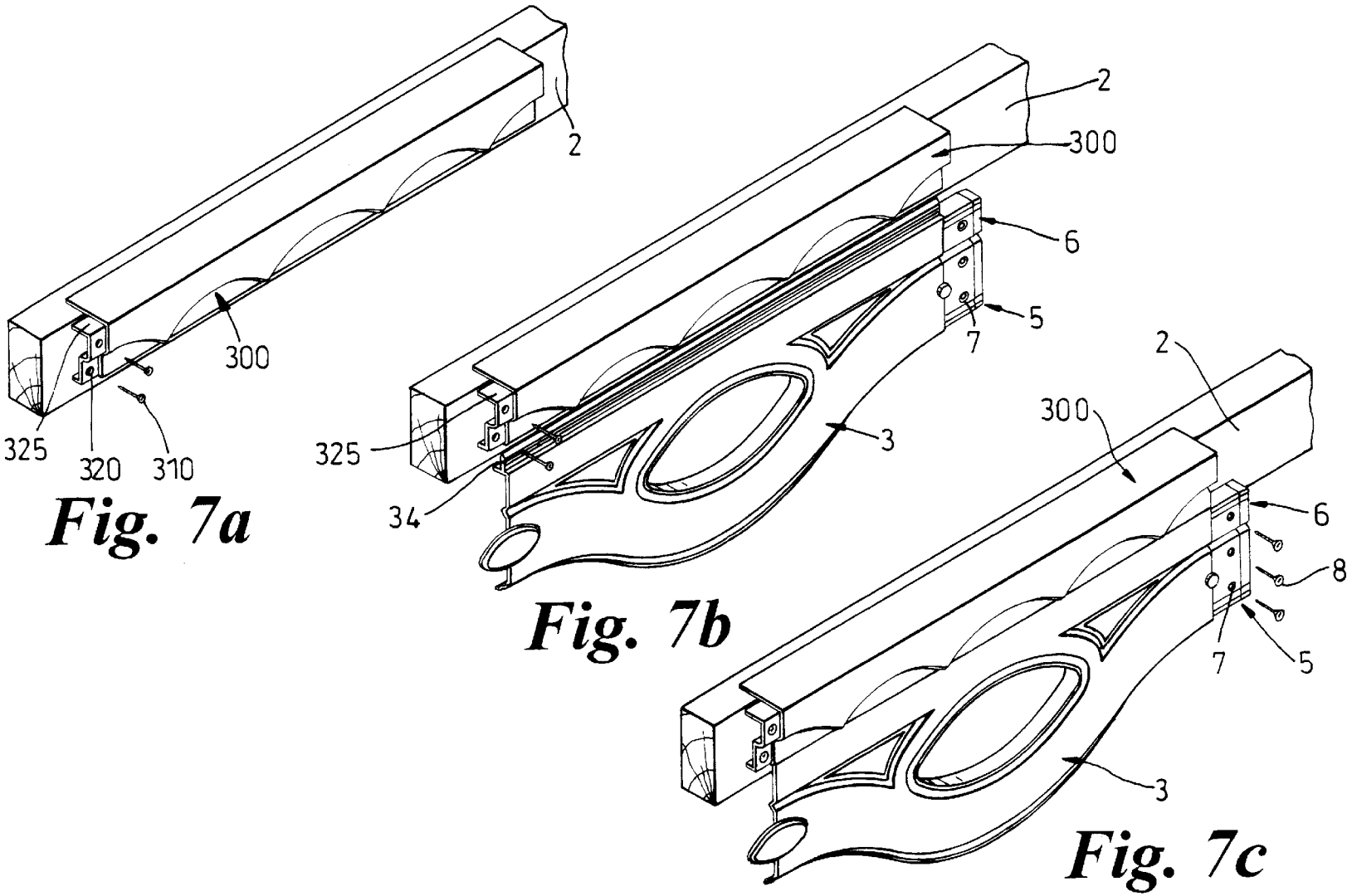
Figure 8:
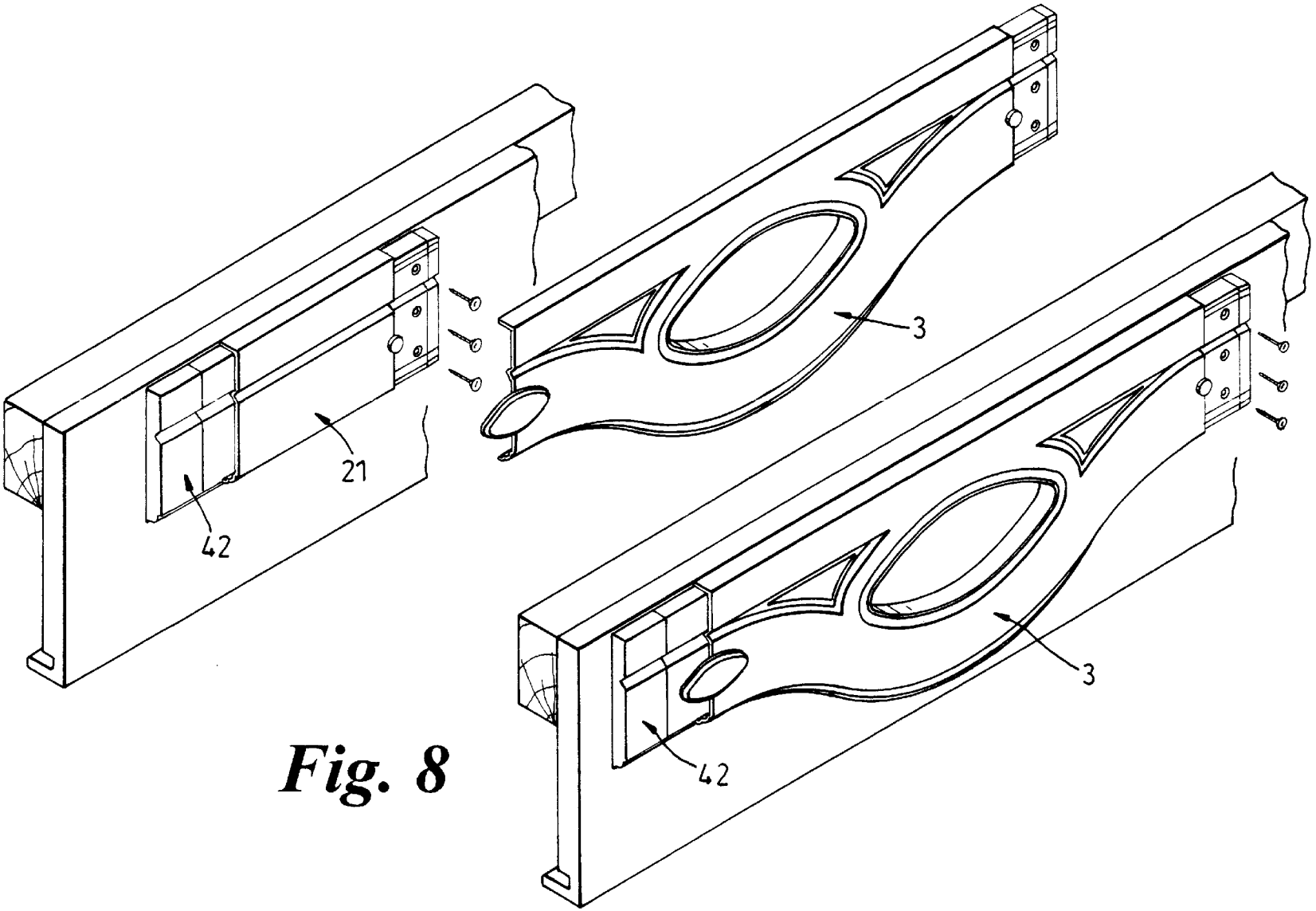
Figures 9A, 9B:
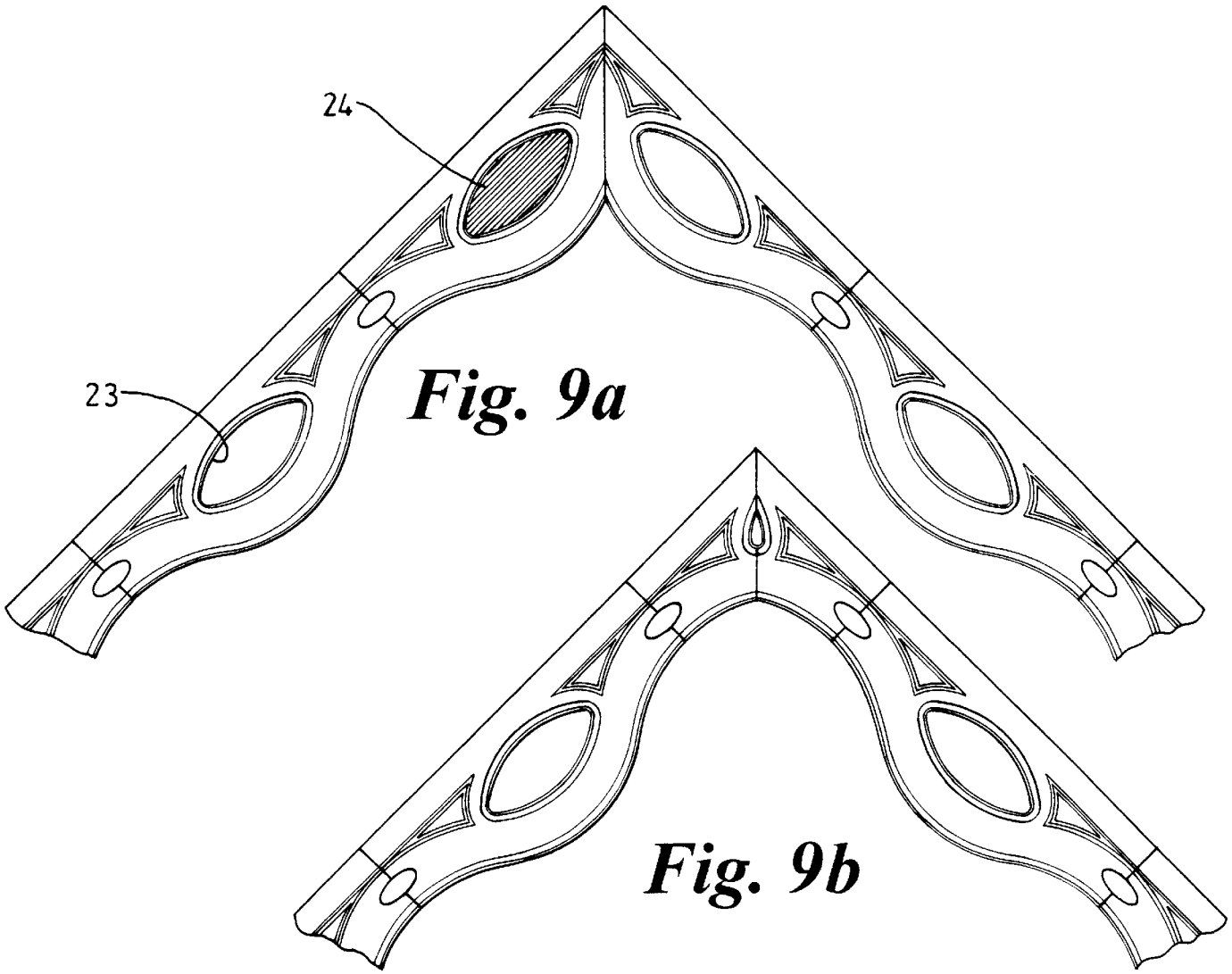

FIG. 5*a–c* shows the use of barge board depth extension means with top fixing to the gable end ladder;

FIGS. 6*a–c* show the use of depth extension means with top fixing to an existing barge board;

FIGS. 7*a–c* show the use of discrete, moulded depth extension means with face fixing to the gable end ladder;

FIG. 8 shows the use of a plain end spacer and end plug;

FIGS. 9*a* and 9*b* show decorative finishes which can be achieved by variation of cutting plane in the decorative member illustrated in FIG. 7;

FIGS. 10*a–f* show a variety of decorative finishes which can be achieved using discrete members having two different patterns on the decorative portions; and FIG. 10*g* shows an optional apex moulding to add extra decorative finish at gable end.

FIG. 1*a* shows a barge board system 1 which is secured to a gable end ladder 2. The barge board system 1 comprises at least two discrete moulded PVC members (only two are shown) 3, 3' having decorative portions 4, 4' having one of two different patterns and fixing portions 5, 5'. The fixing portion 5, 5' comprises an extension 6, 6' to the end 3*a*, 3*a'* of the member 3, 3' in which apertures 7, 7' are provided and through which screws 8, 8' are inserted to secure the member 3, 3' to the gable end ladder 2.

The extension 6 of member 3 is of identical outline to the rear face of end the 3'*b* of member 3' such that end portion 3'*b* is secured over the extension 6 by a positive clipping action to provide a planar surface with the ends 3*a*, 3'*b* of members 3, 3' in mating contact. The screws 8 are concealed by the end 3'*b* covering the extension 6. Decorative devices 9, 9' are moulded onto the end 3*b*, 3'*b* of member 3, 3' to partially cover the joint between the members giving continuity of design.

FIG. 1*b*, where like numerals indicate like features, shows the barge board system of FIG. 1*a* secured to the front face of an existing barge board 13, which is in turn secured to the gable end ladder 2, by means identical to those described in relation to FIG. 1*a*.

In the system illustrated in FIG. 2*a*, where like numerals indicate like features, member 3 of FIG. 1*a* is provided with a second fixing means comprising a lip 10 extending rearwardly of the top edge of the member 3 at right angles thereto whereby member 3 is secured to the top face of the gable end ladder 2 by screws 12 inserted through apertures 11.

FIG. 2*b*, where like numerals indicate like features, shows member 3 of FIG. 2*a* when secured to the top edge 15 and front face 14 of a barge board 13.

The patterns of the decorative portions shown in FIGS. 1*a*, 1*b*, 2*a*, 2*b* are merely illustrative of the range of patterns possible other patterns include dental moulding.

FIGS. 3*a–d* illustrate in detail the method of securing adjacent members 3 to each other by means of a positive clipping action in which member 3 is provided a fixing means 5 comprising an extension 6 having male clip attachments 28 illustrated in FIG. 3*d*, located on the rear of the discrete member 3 at its end 3*a* for co-operation with a corresponding female member 27 at the end 3*b* of an adjacent member.

The arms 27*a* of the female clip attachment 27 can be pressed to fit over the male clip attachments 28 of the fixing means 5 located on extension 6 of the end 3*a* of the adjacent discrete member and are of a suitable length to close around the fixing means 5 and provide a positive clipping action between the female clip attachment 27 and the male clip attachment 28 (see FIG. 3*d*) which secures the members 3, 3' together to extend along a long run.

The extension 6, as shown in FIG. 3*a*, at the end 3*a* enables two members 3, 3' to remain correctly aligned once clipped together and a decorative device 9 is moulded onto the decorative portion 4 at the end 3*b* to cover the joints and provide continuity of design.

FIG. 3*c* shows a scrap section through apertures 7 at the end 3*a* of the discrete member 3 bearing the extension 6 on its rear face and a circular lug 22 on its front face which is of suitable size to fit into an aperture 9*a* provided in the decorative device 9 when two discrete members 3, 3' are correctly aligned. The discrete member 3 is secured to the gable end ladder, rafter end or existing barge board by means of screws (not shown) passing through apertures 7 in extension 6 of fixing means 5.

FIGS. 4*a–d* illustrate a second method of securing adjacent members 3 to each other by means of a positive clipping action in which member 3 is provided with male clip attachments 17 illustrated in FIG. 4d, located on the rear of the discrete member 3 at its end 3*b* for co-operation with a corresponding female member (not illustrated) on the adjacent member.

As shown in FIG. 4*d* the male clip attachment 17 comprises flexible arms 18 joined at the end 18*b*, being spaced slightly apart and having lugs 19 on the end 18*a*.

The arms 18 of the male clip attachment 17 can be pressed together to fit into an aperture in a corresponding female clip attachment located on the opposite end of an adjacent discrete member (not shown) and are of a suitable length to enable the lugs 19 to protrude from the aperture when fully inserted and the arms 18 to regain their slightly spaced apart position. This provides a positive clipping action which secures the members 3, 3' together to extend along a long run.

Each member 3 is also provided with an elongate locating member 20, as shown in FIG. 4*a*, at the end bearing the male clip attachments 17 to enable two members 3, 3' to remain correctly aligned once clipped together and a decorative device 9 is moulded onto the decorative portion 4 at the end 3*b* to cover the joints and provide continuity of design.

FIG. 4*c* shows a scrap section across the end 3*b* of the discrete member 3 bearing the locating member 20 on its rear face and the decorative device 9 on its front face and having a space 23 therebetween to receive the opposite end 3*a*' of an adjacent discrete member 3' therein (not shown).

It is understood that the end 3'*a* of the member 3' to be joined to the end 3*b* of the member 3 does not include a locating member 20 but is provided with female clip attachments (not shown) opposed to the male clip attachment 17.

The discrete member 3 is secured to the gable end ladder, rafter end or existing barge board by means of screws (not shown) passing through apertures 16 in fixing portion 50.

FIGS. 5*a–c*, where like numbers indicate like features, show the use of a depth extension means 30 in combination with a member 3. The means 30 is a continuous extruded strip of plastics material such as PVC having a lip 35 extending at right angle, thereto for top fixing to the gable end ladder, rafter end or existing barge board by means of screws 31 passing through apertures 32. The means 30 is provided with a keyhole or teardrop shaped channel 33 in its lower edge which slidingly receives a corresponding shaped protrusion 34 provided on the upper edge of a member 3 during moulding. When member 3 has been moved into the desired position it can be fixed in place by the fixing means described in FIG. 1*a*.

FIGS. 6*a–c*, where like numbers indicate like features, show the use of the depth extension means 30 of FIGS. 5*a–c* in conjunction with an existing barge board 13.

FIGS. 7*a–c*, where like numbers indicate like features show the use a depth extension means 300 in combination with member 3. The means 300 is a discrete moulded PVC component having a decorative pattern. The means 300 can be secured to the gable end ladder (as shown in FIG. 7*a–c*), a rafter end or an existing barge board (not shown) by means of screws 310 passing through the apertures 320 in an extension 325 to the face of the means 300. Alternatively the moulded means can be provided with a lip for top fixing as shown in FIGS. 5 and 6. The means 300 slidingly receives the member 3 and the member 3 is secured in position and to adjacent members as described in relation to FIGS. 5 and 6. The depth extension means 300 can be used alone to give a decorative finish to areas of the building (not shown).

FIG. 8 shows the use of a plain moulding 21 near the ends of the barge board system 1. Once the member 3 has been cut to give the desired decorative finish e.g. at the gable end, the plain moulding is the only other part of the system which needs to be cut to give the correct length adjustment. The plain moulding 21 is joined to the member 3 by a positive clipping action as described with reference to FIGS. 1*b*, 3*a–d*.

The plain end moulding 21 or member 3 if a plain end spacer 21 is not used, is provided with a solid end plug 42 which can be cut at the required angle determined by the angle of the roof pitch and is secured to spacer 21 or member 3 by means of a push fit attachment.

FIGS. 9*a* and 9*b* show examples of two decorative effects which can be obtained from the same member 3 by butting the ends of the decorative portions at the gable end. The member 3 can be cut at any point along its length and at any angle and therefore the member 3 can be attached to the gable end ladder, rafter end or existing barge board at any point along the length of the member 3. As a result a large number of decorative finishes at the gable end can be obtained.

The decorative portion 4 of member 3 is provided with apertures 23 into which decorative infills 24 of a contrasting colour or additional decorative features can be inserted by means of a snap-fit engagement.

In use, referring to the embodiment of FIG. 7 and the positive clipping action of FIGS. 3*a–d*, the end of the member 21 is aligned with member 3 such that the extension 6 of fixing means 5 is received behind the plain end member 21 and the decorative device 9 is received in front of the member 21 and the male clip attachments 28 engage the corresponding female clip attachments 27 securing the two members 3 and 21 together by a positive clipping action. The decorative device 9 which is moulded onto the member 3 at the end 3*b* covers part of the joint and gives continuity of design.

FIGS. 10*a–f* show a variety of decorative finishes which can be achieved using decorative portions 4, 4' of different patterns in various sequences.

FIGS. 10*g* shows optional apex moulding which can be trimmed to any angle, thus giving an extra decorative finish (shown prior to trimming).

Although reference has been made to members of the same pattern it is to be understood that the decorative portions 4 of the members 3 can be of different patterns and can be alternated in use to give a variety of decorative finishes.

What is claimed is:

1. A barge board system comprising, a plurality of roof timbers, two or more discrete members each having a decorative portion wherein said discrete members and said decorative portions are at least partially in direct contact with said plurality of roof timbers to cover portions of said roof timbers projecting from the roof, a fixing means to secure the discrete members to the projecting roof timbers, and joining means to secure the discrete members to each other.

2. The system according to claim 1 wherein said fixing means comprises portions of said member provided with holes through which screws can pass.

3. The system according to claim 1 wherein said joining means comprises corresponding male and female attachments provided on adjacent discrete members.

4. The system according to claim 3 wherein one end of said member is provided with a female clip attachment and the other end of said member is provided with a male clip attachment whereby the edge portions of adjacent members are in mating contact to provide a planar surface.

5. The system according to claim 1 wherein one end of each said member is provided with a locating member which is secured to the rear face of one said decorative portion and rests against the rear face of an adjacent said decorative portion when the two portions are in mating contact.

6. The system according to claim 1 wherein plain mouldings are provided for use at or near the ends of a run to provide easy length adjustment of said member.

7. The system according to claim 1 wherein decorative infills are provided for use with said member.

8. The system according to claim 1 wherein the joints between said members fixed along the long run of soffit are at least partially covered by a further decorative device.

9. The system according to claim 1 wherein the projecting roof timbers are selected from the group consisting of a gable end ladder, rafter end portions and an existing barge board.

10. The system according to claim 9 wherein said fixing means are provided in one or both ends of the face of said member for cooperation with the edge of said gable end ladder, the face of said existing barge board or said rafter end portion of said building.

11. The system according to claim 9 wherein said fixing means are provided along the top edge of the face of said member for cooperation with the edge of said gable end ladder, the face of said existing barge board or said rafter end portion of said building.

12. The system according to claim 9 wherein said fixing means comprises laterally projecting extensions of one or both ends or the top edge of the face of said member for cooperation with the edge of said gable end ladder, the face of said existing barge board or said rafter end portion of a building.

13. The system according to claim 9 wherein said member is fixed by said fixing means to the top of said rafter end portion, the top of said gable end ladder or the top of said existing barge board, and said fixing means is a lip provided along the top edge of said member at an angle thereto for cooperation with the top of said gable end ladder, exiting barge board or rafter end portion.

14. The system according to claim 13 wherein said angle is a right angle.

15. The system according to claim 1 wherein the building roof includes roof tiles supported on said roof timbers, further comprising means to extend the depth of said discrete members from the underside of the tiles of said building provided above said barge board system in order to enhance visibility of said barge board system from the ground.

16. The system according to claim 15 wherein said depth extension means is a continuous extruded strip of plastics material.

17. The system according to claim 15 wherein said depth extension means comprises discrete moulded components.

18. The system according to claim 15 wherein said depth extension means is provided with fixing means to secure the depth extension means to projecting roof timbers and joining means by which the depth extension means are secured to each other.

19. The system according to claim 15 wherein said member is secured to said depth extension means by male female attachment.

* * * * *